United States Patent [19]

Nakao

[11] Patent Number: 4,615,709

[45] Date of Patent: Oct. 7, 1986

[54] CATIONIC COMPOUND, PROCESS FOR PREPARING SAME AND TREATMENT OF TEXTILE MATERIAL FOR IMPROVED DYEING

[75] Inventor: Katsuaki Nakao, Yamatotakada, Japan

[73] Assignee: Ipposha Oil Industries Co., Ltd., Ono, Japan

[21] Appl. No.: 682,457

[22] Filed: Dec. 17, 1984

[30] Foreign Application Priority Data

Dec. 16, 1983 [JP] Japan ..... 58-238484

[51] Int. Cl.[4] ..... D06M 13/46; C09B 67/00

[52] U.S. Cl. ..... 8/599; 8/543; 8/551; 8/554; 8/576; 8/606; 8/612; 8/650; 8/653; 8/680; 8/917; 8/918; 8/921; 549/514; 549/521; 549/551

[58] Field of Search ..... 8/599, 606, 612, 576, 8/551, 554

[56] References Cited

U.S. PATENT DOCUMENTS

| | | | |
|---|---|---|---|
| 4,313,732 | 2/1982 | Teague et al. | 8/541 |
| 4,331,441 | 5/1982 | Dvorsky et al. | 8/542 |
| 4,369,041 | 1/1983 | Dvorsky et al. | 8/532 |
| 4,380,453 | 4/1983 | Claiborne | 8/606 |
| 4,441,884 | 4/1984 | Baumann et al. | 8/542 |
| 4,447,243 | 5/1984 | Claiborne | 8/188 |

FOREIGN PATENT DOCUMENTS 46-40510 11/1971 Japan .

*Primary Examiner*—A. Lionel Clingman

*Attorney, Agent, or Firm*—Armstrong, Nikaido, Marmelstein & Kubovcik

[57] ABSTRACT

A cationic compound of the formula [I] below is used for improving the dyeing properties of a textile material by treating therewith the textile material before or after dyeing with an anionic dye.

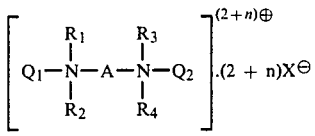

[I]

wherein A is a group of the formula [II]:

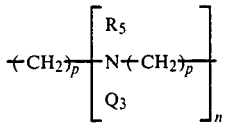

[II]

wherein p and q are an integer of 1 to 8, n is an integer of 0 to 2, X is halogen, $R_1$, $R_2$, $R_3$, $R_4$ and $R_5$ are (C1-4) alkyl, OH— or cyano-substituent-having (C1-4) alkyl or (C1-4) alkenyl, and $Q_1$, $Q_2$ and $Q_3$ are:

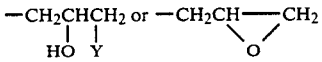

in which Y is halogen.

7 Claims, No Drawings

CATIONIC COMPOUND, PROCESS FOR PREPARING SAME AND TREATMENT OF TEXTILE MATERIAL FOR IMPROVED DYEING

BACKGROUND OF THE INFORMATION (1) Field of the Invention

The present invention relates to a method for improving the dyeing properties of a textile material composed of a natural fiber, a regenerated fiber, a semisynthetic fiber, a synthetic fiber or a mixture thereof by treating the textile material with a novel cationic compound represented by the general formula [I], shown below, before or after dyeing with an anionic dye. It also relates to the novel cationic compound represented by the general formula [I], and a process for the preparation of said compound.

(2) Description of the Related Art

Ordinarily, when a textile material is dyed with an anionic dye, an appropriate anionic dye is selected according to the kind of the textile material, and the textile material is dyed according to a recipe (dyeing method or use of a dyeing assistant) suitable for the textile material. For example, a direct dye, a reactive dye, a sulfide dye, a vat dye, a naphthol dye, an indigo dye and a Rapidogen dye have been used for dyeing a textile product of a cellulose fiber or a polyvinyl alcohol fiber. An acid dye or a metal complex dye used for dyeing wool or silk or a polyamide fiber has a low affinity with a cellulose fiber, and therefore, the dye exhaustion is insufficient and the color fastness is low. Accordingly, the acid dye or metal complex dye is not practically used for a cellulose fiber.

In contrast, when a direct dye is used, it is difficult to sufficiently dye a polyamide fiber or wool or silk.

Accordingly, a textile material composed of fibers differing in dyeability, for example, a mix-spun product or union fabric of a cellulose fiber and a polyamide fiber, is dyed two times by using different dyes. This method is disadvantageous in cost and operation efficiency. Recently, many conjugate fibers formed by combining different fibers at the spinning step have been developed for improving various physical properties such as strength and touch. However, dyeing of these conjugate fibers is greatly limited and the capacities of these fibers are not sufficiently exerted.

From the viewpoint of the fashion, it is preferred that the number of colors be large. However, there is a color that cannot be produced by a certain type of dyes and, thus, the hue or color number is limited in a certain kind of a fiber.

Various attempts have been made to solve these problems, but almost no satisfactory results have been obtained. For example, the following attempts can be mentioned.

(1) It has been known from old that a textile material of a cellulose fiber is treated with an adduct of a polyalkylene-polyamine and epichlorohydrin or formalin before or after dyeing with a direct dye or a reactive dye. However, compounds of this type considerably reduce the fastness, especially the light fastness, and its application is limited.

(2) Use of a quaternary compound having one reactive group capable of reacting with a textile material of a cellulose fiber, such as 3-chloro-2-hydroxypropyltrimethylammonium chloride or 2,3-epoxypropyltrimethylammonium chloride, has been proposed (see, for example, Japanese Examined Patent Publications No. 39-5985 and No. 46-40510). These compounds show a considerably excellent dyeability (for example, an improved dye exhaustion). However, these compounds are reacted with a textile material of a cellulose fiber to a minor extent even under relatively violent conditions (for example, at a high temperature, at a high pH value and for a long time). Namely, the reaction ratio is low and the compounds should be used in large quantities. Therefore, this proposed is disadvantageous from the economical viewpoint and the improvements of the dye exhaustion and the fastness are not satisfactory.

(3) Use of the fiber-reactive cationic compounds has been proposed (see, for example, Japanese Unexamined Patent Publication No. 52-155286). This compound contains a halogeno-triazine group or a halogeno-pyrimidine group as the reactive group. This compound is still insufficient in reactivity with a textile material of a cellulose fiber and is expensive. Accordingly, the practical utility of this compound is very low.

SUMMARY OF THE INVENTION

In view of the foregoing, it is an object of the present invention to provide a fiber-reactive cationic compound that can be applied to general anionic dyes and can improve the dye utilization ratio and the color fastness in various textile materials of natural fibers and other fibers.

Another object of the present invention is to provide a method of improving dyeing properties of a textile material by using the above-mentioned fiber-reactive cationic agent. This method is also advantageous in the effect of rationalizing the dyeing process and the resource-saving and energy-saving effects.

The fiber-reactive cationic compound of the present invention is represented by the following general formula [I]:

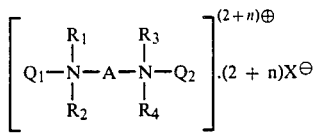

[I]

wherein A is a group represented by the following general formula [II]:

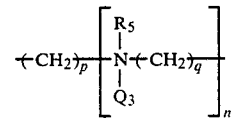

[II]

in which p and q are an integer of 1 to 8, n is an integer of 0 to 2, X is a halogen atom, $R_1$, $R_2$, $R_3$, $R_4$ and $R_5$ are independently an alkyl group having 1 to 4 carbon atoms, an alkyl group having 1 to 4 carbon atoms, which has at least one substituent selected from group consisting of a hydroxyl group or a cyano group, or an alkenyl group having 1 to 4 carbon atoms, and $Q_1$, $Q_2$ and $Q_3$ are independently a group of the following formula:

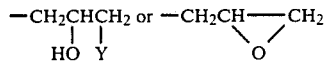

in which Y is a halogen atom and X and Y may be the same or different.

The above-mentioned compound is used for the treatment of a textile material composed of a natural fiber, a regenerated fiber, a semisynthetic fiber, a synthetic fiber or a mixture thereof before or after dyeing of the textile material with an anionic dye.

DESCRIPTION OF PREFERRED EMBODIMENTS

The compound [I] of the present invention has at least 2 quaternary ammonium group in one molecule and at least 2 reactive groups selected from halohydrin and epoxy groups. Accordingly, the compound [I] of the present invention has a higher molecular weight and higher affinity and reactivity with a textile material than the above-mentioned known compound having one chlorohydrin or epoxy group as the reactive group, such as 3-chloro-2-hydroxypropyltrimethylammonium chloride and 2,3-epoxypropyltrimethylammonium chloride. Furthermore, the compound [I] is soluble in water and reacts with a textile material at a high efficiency in the presence of an alkali catalyst.

The cationic compound of the general formula [I] is synthesized according to various reactions.

For example, a compound represented by the following general formula: [IV]:

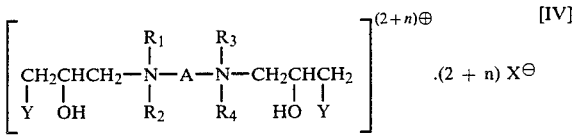

[IV]

wherein A, $R_1$, $R_2$, $R_3$, $R_4$, X and Y are the same as defined in the formula, is obtained by reacting 1 mole of a poly-tert-amine represented by the following formula: [III]:

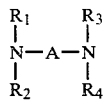

[III]

wherein A, $R_1$, $R_2$, $R_3$, and $R_4$ are the same as defined in the formula [I], with at least (2+n) moles (more specifically, the mole number is at least the number of the nitrogen atoms contained in the poly-tert. amine of the formula of a 1,3-dihalogeno-2-propanol.

Furthermore, when 1 mole of this compound of the formula [IV] is reacted with at least about one mole of an alkali such as an alkali metal hydroxide or carbonate, there is obtained a compound represented by the formula [I] wherein at least one of $Q_1$, $Q_2$ and $Q_3$ in group A is a group represented by the following formula:

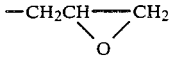

and the remainder of $Q_1$, $Q_2$ and $Q_3$ is a group represented by the following formula:

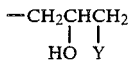

wherein Y is the same as defined in the formula [I].

As specific examples of the poly-tert amine represented by the general formula, there can be mentioned N,N,N',N'-tetramethylmethylene-diamine, N,N,N',N'-tetramethyl-1,2-diaminoethane, N,N,N',N'-tetramethyl-1,3-diaminopropane, N,N,N',N'-tetramethyl-1,6-hexamethylene-diamine, N,N,N', N'-tetraallyl-1,4-diaminobutane, N,N,N',N',N''-pentamethyldiethylenetriamine, N,N,N',N'-tetraethyl-1,3-diaminopropane, N,N,N',N'-tetra(hydroxyethyl)-1,3-diaminopropane, N,N,N',N'-tetra(cyanoethyl)-1,3-diaminopropane, N,N,N',N'-tetra(cyanoethyl)-1,6-hexamethylenediamine, di(8-dimethylaminooctyl)methylamine and N,N'-bis(8-dimethylaminooctyl)-N,N'-1-8-dimethylaminooctane. Of course, poly-tert amines that can be used in the present invention are not limited to those exemplified above.

Conditions for the reaction of preparing the compound of the formula [IV] from the poly-tert-amine [III] may be the same as those customarily adopted in the known process for preparing a quaternary ammonium salt from a tertiary. amine and a halide. For example, water, a water-soluble solvent or a mixture thereof may be used as the reaction solvent, and the reaction temperature is 30° to 150° C. and preferably 70° to 100° C.

The state of advance (or conversion) of formation of the cationic compound in this reaction can be known by determining the halogen ion of the quaternary ammonium salt formed in the reaction mixture. Determination of the halogen ion can be easily accomplished according to the silver nitrate method or the method using an ion meter. It sometimes happens that the unreacted starting compounds, a small amount of a polymeric compound and a by-product are present in the reaction product. However, since the conversion of this reaction is ordinarily high, if it is judged that the dyeing properties are not influenced to a significant degree by the presence of such compounds, the reaction product can be directly used for attaining the object of the present invention without purification.

A compound of the following formula [V]:

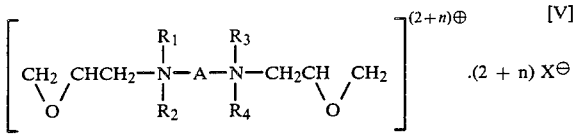

[V]

wherein A, $R_1$, $R_2$, $R_3$, $R_4$, X and Y are the same as defined in the formula [I], except that $Q_3$ in A is a group of the following formula:

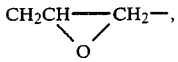

is prepared by adding a predetermined amount of an alkali such as sodium hydroxide, potassium hydroxide, sodium carbonate or potassium carbonate to a solution of the compound of the formula [IV]. Water, a water-soluble solvent or a mixture thereof is preferred as the reaction solvent. The reaction is exothermically advanced. Since the formed epoxy group is readily decomposed at a higher temperature and a higher pH value, the reaction mixture is cooled so that the reaction temperature is 0° to 50° C., preferably 0° to 30° C. The alkali is added so that the pH value is maintained at a level at least 7 during the reaction. When the formed compound of the formula [V] is stored for a long time, the pH value is maintained at 6 to 8.

The compound of the formula [IV] can also be prepared from the poly-tert-amine of the formula [III] according to the following procedures. At first, a hydrogen halide salt of the poly-tert-amine of the formula [III] is prepared. Then, the hydrogen halide is reacted with an epihalohydrin in an alcohol or a mixed solvent of an alcohol and water. Thus, the cationic compound of the formula [IV] is obtained.

The compound of the formula [V] can also be prepared according to the following process.

Namely, 1 mole of the poly-tert-amine of the formula [III] is reacted with at least (2+n) moles of an epihalohydrin of the following formula [VI]:

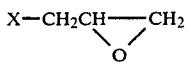

[VI]

wherein X is a halogen atom, to form a quaternary ammonium salt, whereby the cationic compound of the formula [V] can be directly obtained.

As is apparent from the foregoing description, the fiber-reactive compound [I] can be prepared according to several processes. Accordingly, the present invention is advantageous in view of rationalization of the preparation steps and from the economical viewpoint. Furthermore, these preparation processes are valuable as alternate processes to one another for confirmation of reaction products, and this confirmation of reaction products can be performed according to ordinary procedures adopted in the organic chemistry.

The textile material to be treated with the above-mentioned compound according to the present invention is a textile material containing, for example, hydroxyl, amino, amide and carboxyl groups. For example, there can be mentioned natural fibers such as cellulosic fibers, silk and wool, regenerated (man-made) fibers such as viscose man-made fibers, cuprammonium man-made fibers and soybean protein man-made fibers, semisynthetic fibers such as acetate fibers, synthetic fibers such as polyamide fibers and polyvinyl alcohol fibers, and mixtures thereof. When a textile material of a cellulose fiber is treated, an especially high effect can be attained.

The form of the textile material is not particularly critical. For example, the textile material may be in the form of a staple fiber, a yarn, a woven fabric or a knitted fabric.

Customary methods for treating textile materials can be adopted for treating a textile material with the cationic compound (fiber-reactive cationic compound) of the general formula [I]. For example, there can be mentioned dipping methods such as a room temperature standing method and a heating agitation method, and padding methods such as a pad roll method, a pad dry method, a pad dry cure method and a pad steam method. Furthermore, a printing method and a spray method may also be employed.

It is preferred that the treatment be carried out before dyeing. However, the treatment may be conducted after dyeing.

It is preferred that the treatment be carried out in the state where the cationic compound of the general formula [I] is kept in the presence of an alkali. However, the alkali need not be used when a textile material or dye having a low resistance to the alkali is used. As the alkali, there are preferably used sodium hydroxide, potassium hydroxide, sodium carbonate, potassium carbonate, sodium bicarbonate and potassium bicarbonate. The alkali is used in an amount of 1 to 100% by weight based on the cationic compound of the general formula [I].

In the case where $Q_1$, $Q_2$ and $Q_3$ in the cationic compound of the general formula [I] are an epoxy group, it is preferred that the alkali be used in an amount of 1 to 30% by weight based on the compound of the general formula [I]. However, in the case where $Q_1$, $Q_2$ and $Q_3$ are a halohydrin group, it is preferred that the alkali be used in an amount of 10 to 50% by weight based on the compound of the general formula [I].

The amount of the cationic compound of the general formula [I] is varied according to the amount of the dye used, the amount of the textile material and the treating method. A treating solution having a concentration of 1 to 200 g/l is preferably used.

At any rate, it is preferred that the interior of the textile material be sufficiently impregnated with the treating solution. Accordingly, the combined use of a penetrant, a solvent and a thickener or the heating of the treating solution is naturally effective. However, use of a large amount of a compound forming an insoluble substance by coupling with the cationic compound of the general formula [I], for example, a polymeric anionic activating agent or a compound having an active group such as an amino group should be avoided. Since decomposition of the cationic compound of the general formula [I] is enhanced at a high temperature in the presence of an alkali, long-time standing of the treating solution should be avoided.

As the anionic dye, there can be mentioned a direct dye, a reactive dye, an acid dye, a metal-containing dye (a kind of the acid dye), an indigo dye and a vat dye. These dyes are ordinarily used in the form of an aqueous solution.

When a textile material treated with the cationic compound of the general formula [I] before dyeing is dyed with a dye such as mentioned above, the textile material is impregnated with an aqueous solution containing the dye at a predetermined concentration and, if necessary, the textile material is heated. For example, the printing method, the dip dyeing method, the thermosol method and the cold batch method are adopted for the dyeing operation.

Other chemicals, for example, Glauber salt, sodium chloride and an alkali such as sodium hydroxide or soda ash, addition of which is indispensable in the conventional dyeing method, should not necessarily be added to the aqueous solution of the dye. However, a penetrant or a small amount of an inorganic salt or a surface active agent may be added.

According to the conventional techniques, a cellulosic fiber can be dyed with an acid dye or metal-containing dye only to such a degree as staining, or wool is dyed with a direct dye only to such a degree as staining, and no practical dyeing effect can be obtained. In contrast, according to the above-mentioned method of the present invention, a cellulosic fiber can be dyed in a deep color with an acid dye or metal-containing dye and wool can be dyed in a deep color with a direct color. Furthermore, the color fastness of the dyed product is very excellent.

When a textile material is treated with the cationic compound of the general formula [I] after dyeing, the fastness of the dyed product is improved, and use of a fixing agent customarily used after the dyeing operation becomes unnecessary or the amount of this agent used can be reduced.

As is apparent from the foregoing description, according to the present invention, general anionic dyes can be practically used for various textile materials of natural fibers and other fibers, and dyeing of mix-spun products and union fabrics composed of various fibers and products of conjugate fibers can be accomplished by one step at a high efficiency. Furthermore, since general anionic dyes can be used for a certain fiber, the number of colors is increased and the fashion characteristics of garments can be enhanced. Moreover, the obtained product is excellent in fastness characteristics such as the light fastness, and the dyeing process and apparatus customarily used can be directly employed and the dyeing operation can be completed within a relatively sort time, with the result that excellent energy-saving and cost-reducing effects can be attained.

The process for the preparation of the fiber-reactive cationic compound of the present invention and the dyeing method using this cationic compound will now be described in detail with reference to the following Synthesis Examples and Examples.

SYNTHESIS EXAMPLE 1

A three-necked flask equipped with a stirring rod, a thermometer and a condenser was charged with 130 g of N,N,N',N'-tetramethyl-1,3-diaminopropane, 270 g of 1,3-dichloro-2-propanol, 130 g of water and 270 g of isopropanol, and the temperature was elevated by heating and the reaction was carried out at 80° to 90° C. for 5 hours.

The reaction mixture liquid showed a strong alkalinity at the initial stage, but finally, a light-yellow transparent homogeneous solution having a pH value of about 6.8 was obtained. The chlorine ion content in the solution was 8.7% (theoretical value=8.9%) as determined according to the silver nitrate method, and it was confirmed that the quaternary ammonium salt was formed in a yield of about 98%. Namely, the obtained solution was an aqueous solution containing about 49% of trimethylene-bis(3-chloro-2-hydroxypropyl-dimethylammonium chloride) having the following structure:

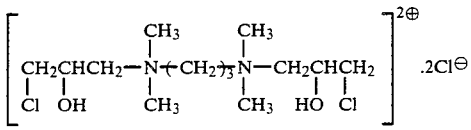

SYNTHESIS EXAMPLE 2

A three-necked flask equipped with a stirring rod, a condenser and a thermometer was charged with 172 g of N,N,N',N'-tetramethyl-1,6-hexamethylenediamine, 442 g of water and 270 g of 1,3-dichloro-2-propanol, and the temperature was elevated under violent agitation by heating and the reaction was carried out at 95° to 100° C. for 5 hours. The reaction mixture was a light-yellow transparent homogeneous solution having a pH value of 6.8. The chlorine ion content in the solution was 8.1% (theoretical value=8.3%), and it was confirmed that the quaternary salt was formed in a yield of 97.6%. Namely, the obtained solution was an aqueous solution containing about 49% of hexamethylene-bis(3-chloro-2-hydroxypropyl-dimethylammonium chloride).

Then, 50 g of the aqueous solution was poured into 300 ml of acetone under sufficient agitation, and the mixture was allowed to stand, whereby the mixture was separated into two layers. The upper acetone solution layer was removed by gentle decantation. The lower layer was a colorless viscous liquid, and its amount was about 28 g. Then, 100 ml of acetone was added to the lower layer, and the mixture was sufficiently kneaded, washed and allowed to stand to separate the mixture into two layers. The acetone solution (upper layer) was removed. This acetone washing was further conducted two times, and when acetone was removed by distillation at 40° C. by means of a rotary evaporator, 20 g of a highly viscous, light-yellow transparent paste was obtained. This paste was easily soluble in water, and the aqueous solution was neutral. The chlorine ion content in the paste was 16.4% (theoretical value=16.5%) as determined according to the silver nitrate method. The paste was dissolved in heavy water ($D_2O$) and the NMR spectrum measurement (JEOL JNM-FX100 supplied by Nippon Denshi K.K.) was carried out at 25 MHz by using DSS (sodium 2,2-dimethyl-2-silapentanesulfonate) as the reference standard substance and the carbon atom having the mass number of 13. The obtained δ values (ppm) were 23.7 (t), 26.9 (t), 49.4 (t), 53.6 (q), 53.9 (q), 67.2 (d), 67.4 (t) and 67.8 (t).

The compound had the following structure formula.

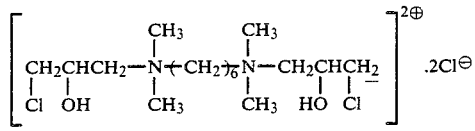

SYNTHESIS EXAMPLE 3

A flask equipped with a stirring rod and a thermometer was charged with 400 g of the solution of trimethylene-bis(3-chloro-2-hydroxypropyl-dimethylammonium chloride) obtained in Synthesis Example 1, and the charge was sufficiently stirred and cooled in a water bath. Then, 100 g of a 50% aqueous solution of sodium hydroxide was carefully added to the charge so that the temperature of the reaction system was maintained below 30° C. After stopping of generation of heat, stirring was conducted at 30° C. for 30 minutes and neutralization was performed with dilute hydrochloric acid to adjust the pH value to 7, whereby a light-yellow transparent solution of trimethylene-bis(2,3-epoxypropyl-dimethylammonium chloride) was obtained. The obtained compound had the following structural formula:

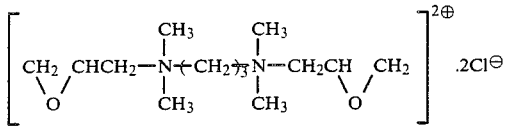

SYNTHESIS EXAMPLE 4

A 4-necked flask equipped with a stirring rod, a condenser, a thermometer and a dropping funnel was charged with 172 g of N,N,N',N'-tetramethylhexamethylenediamine, and 209 g of 35% aqueous hydrochloric acid was dropped thereto under ice cooling. Violent formation of white smoke and generation of heat were caused. When the mixture was stirred at 50° C. for 1 hour after the dropwise addition, formation of white smoke was stopped and a faintly yellow transparent solution was obtained.

Then, 185 g of epichlorohydrin was slowly dropped to the mixture under such cooling that the mixture was maintained at 50° C. The reaction mixture was aged at 50° C. for 30 minutes after completion of the dropwise addition. Stopping of the exothermic reaction was confirmed, and the temperature was elevated and the reaction was conducted at 95° to 100° C. for 3 hours to obtain a light-yellow transparent viscous liquid. Water was added to the liquid so that the total amount was 860 g. The chlorine ion content in the liquid was 8.1% (theoretical value=8.3%).

When the solution was washed with acetone in the same manner as described in Synthesis Example 2, a light-yellow transparent paste similar to that obtained in Synthesis Example 2 was obtained. The NMR spectrum measurement was carried out by using the carbon atom having the mass number of 13, and the obtained δ values (ppm) were 23.7 (t), 26.9 (t), 49.4 (t), 53.6 (q), 53.9 (q), 67.2 (d), 67.4 (t) and 67.8 (t). These values were in agreement with the values obtained in Synthesis Example 2, and it was confirmed that the same hexamethylene-bis(3-chloro-2-hydroxypropyldimethylammonium chloride) could be synthesized by the different method.

SYNTHESIS EXAMPLE 5

A 3-neck flasked equipped with a stirring rod, a thermometer and a condenser was charged with a mixture comprising 341 g of di(8-dimethylaminooctyl)methylamine, 720 g of 1,3-dibromo-2-propanol, 60 g of water and 1000 g of ethyl cellosolve, and the temperature was elevated by heating and the reaction was carried out at 70° to 80° C. for 6 hours to obtain 2121 g of a light-yellow transparent solution having a pH value of about 6.

The bromine ion content in the solution was 10.9% (theoretical value=11.3%). Accordingly, it was confirmed that the solution contained about 48% of a compound having the following structure:

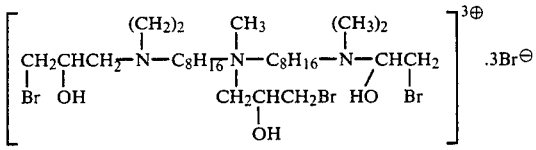

SYNTHESIS EXAMPLE 6

A 4-necked flask equipped with a stirring rod, a condenser, a thermometer and a dropping funnel was charged with 482 g of N,N'-bis(8-dimethylaminooctyl)-N,N'-1,8-dimethylaminooctane dissolved in 400 g of dimethylformamide, and 550 g of epibromohydrin was further added and the temperature was elevated to 90° C. by heating. The reaction was carried out for 4 hours. The reaction mixture was a light-yellowish brown transparent homogeneous solution easily soluble in water. Water was added to the solution so that the total amount was 2060 g. The pH value of the obtained solution was 6.5, and the bromine ion content was 15.0% (theoretical value=15.5%). Accordingly, it was confirmed that the solution contained about 48% of a compound represented by the following formula:

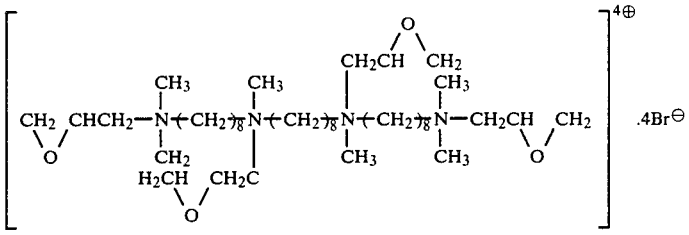

SYNTHESIS EXAMPLE 7

A 4-necked flask equipped with a stirring rod, a condenser, a thermometer and a dropping funnel was charged with 328 g of N,N,N',N'-tetra(cyancethyl)-1,6-hexamethylenediamine and 200 g of isopropyl alcohol, and 209 g of 35% aqueous hydrochloric acid was slowly dropped under cooling and stirring. After completion of the dropwise addition, the mixture was aged at about 50° C. for 1 hour. Then, 185 g of epichlorohydrin was gently dropped to the mixture under such water cooling that the temperature was maintained below 50° C. After completion of the dropwise addition, the mixture was aged at 50° C. for about 30 minutes, and the temperature was gradually elevated and the reaction was conducted under reflux of isopropyl alcohol for 20 hours to obtain a slightly viscous, light-yellowish brown transparent solution. Water was added to the mixture so that the total amount was 1172 g. The chlorine content in the solution was 5.9% (theoretical value=6.1%). Accordingly, it was confirmed that the solution contained 48% of hexamethylene-bis[3-chloro-2-hydroxypropyldi(cyancethyl)ammonium chloride].

This compound had a structure represented by the following formula:

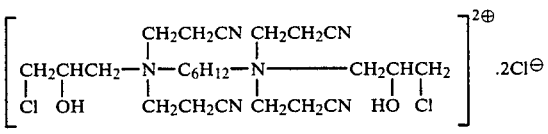

SYNTHETIC EXAMPLE 8

A 4-necked flask equipped with a stirring rod, a condenser, a thermometer and a dropping funnel was charged with 172 g of N,N,N',N'-tetramethyl-1,6-hexamethylenediamine, 357 g of dioxane and 185 g of epichlorohydrin, and the mixture was heated and maintained at 75° C. for 8 hours. The reaction mixture became soluble in water. This fact indicated that a quaternary ammonium salt was formed. The chlorine content in the formed solution was 9.6% (theoretical value=9.9%), and the conversion was 97%. The solution contained about 48% of hexamethylene-bis(2,3-epoxypropylammonium chloride) having the following structure:

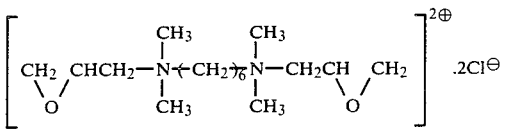

Examples will now be described. In the Examples, all of "%" are by weight.

EXAMPLE 1

A 1.2% aqueous solution of sodium hydroxide was added to an aqueous solution containing 3.2% of hexamethylene-bis(3-chloro-2-hydroxypropyldimethylammonium chloride) obtained in Synthesis Example 1 (or 4) to prepare a treating solution.

A scoured cotton broadcloth was dipped in the treating solution at room temperature for 0.5 minute, and the cloth was squeezed by rolls at a pickup of 80% by rolls and was immediately dried in a hot air drier maintained at 110° C. for 10 minutes. Then, the cloth was washed with a sufficient amount of water, and a small amount of acetic acid was added to the washing water to neutralize it. The washing water was exchanged with fresh water and the cloth was washed with water again. The cloth was then air-dried. Thus, the preliminary treatment to be conducted before dyeing was completed.

The treated cloth was immersed in an aqueous dye solution of Remazol Brilliant Red F-3B (reactive dye supplied by Hoechst AG) having a concentration adjusted to 3% o.w.f. after the cloth had been cut so that the bath ratio was 1:20. The temperature was elevated by heating and dyeing was carried out at 60° C. for 30 minutes. Subsequently, the cloth was sufficiently washed with water and then air-dried. The cloth was dyed in a sharp deep red color. The dyed cloth had a good wet fastness and a high light resistance.

COMPARATIVE EXAMPLE 1-1

The same scoured cotton broadcloth as used in Example 1 was dyed in the same manner as in Example 1 except that the preliminary treatment was not carried out. The cloth was dyed only in a very faint red color, and although the dyed cloth was of a very faint red color, the wet fastness was very low.

COMPARATIVE EXAMPLE 1-2

The preliminary treatment and dyeing treatment were carried out in the same manner as described in Example 1 except that commercially available 3-chloro-2-hydroxypropyltrimethylammonium chloride was used instead of the cationic compound used in Example 1. A cloth dyed in a sharp red color was obtained, but the surface color density was much lower than that of the colored cloth obtained in Example 1. This difference was apparent even by the naked eye observation, and this difference was also obvious from the results (L values) of the measurement using a color difference meter (Model Z-1001-DP supplied by Nippon Denshoku Kogyo K.K.), which are shown in Table 1. The L value indicates the brightness, and a larger L value means a higher brightness, that is, a lower surface color density. In addition to the L values, various fastness characteristics were determined with respect to the dyed cloths obtained in Example 1 and Comparative Examples 1-1 and 1-2. The obtained results are shown in Table 1. In Table 1, the "untreated white cloth" is the cotton broadcloth used in Example 1.

The water fastness was determined according to the method of JIS L-0846A (4 hours) by judging the degree of staining of attached cotton shirting by a gray scale for judging the staining degree. The aging fastness was determined according to the method of JIS L-1846-A for determining the water fastness by dipping the sample in a 1% aqueous solution of acetic acid (bath ratio=1:50). The aging fastness was evaluated as in case of the water fastness. The bleeding fastness was determined according to the method of JIS L-1846-A for determining the water fastness by dipping the sample in an aqueous solution containing 5 g/l of phosphorus-free New Beads detergent (bath ratio=1:50) for 30 minutes. The bleeding fastness was evaluated as in case of the water fastness. The light fastness was determined according to the method of JIS L-0842 by judging the fading degree of a sample by a gray scale for judging the color fading after 20 hours' exposure by a fade-Ometer.

These measurements were similarly conducted in the subsequent Examples and Comparative Examples. The obtained results are shown in Tables 2 through 9. The "untreated white cloth" in each of Tables 2 through 7 indicates the untreated and undyed white cloth.

TABLE 1

| Measurement Item | Example 1 | Comparative Example 1-1 | Comparative Example 1-2 | Untreated White Cloth |
|---|---|---|---|---|
| Color Difference Meter (L value) | 29.26 | 63.62 | 35.19 | 76.66 |
| Water Fastness | 5 | 3 | 4 | — |
| Aging Fastness | 5 | 2 | 3 | — |
| Bleeding Fastness | 4 | 2 | 3 | — |
| Light Fastness | 5 | 4 | 4 | — |

EXAMPLE 2

A treating liquid solution was prepared by adding 3% of potassium carbonate to an aqueous solution containing 5% of hexamethylene-bis[3-chloro-2-hydroxypropyldi(cyanoethyl)ammonium chloride] obtained in Synthesis

EXAMPLE 7

A scoured nylon 66 jersey was immersed in the treating solution and squeezed at a pickup of 80% by a mangle. The cloth was dried and heat-treated at 120° C. for 15 minutes, washed sufficiently with water and dyed with the same aqueous dye solution as used in Example 1. The nylon cloth was dyed in a sharp red color and the color fastness was good.

COMPARATIVE EXAMPLE 2

The same nylon cloth was dyed in the same manner as in Example 2 except that the preliminary treatment was not carried out. The cloth was dyed only in a very faint color and the color fastness was very low.

The measurement results obtained in Example 2 and Comparative Example 2 are shown in Table 2.

TABLE 2

| Measurement Item | Example 2 | Comparative Example 2 | Untreated White Cloth |
|---|---|---|---|
| Color Difference | 34.17 | 50.24 | 72.71 |

TABLE 2-continued

| Measurement Item | Example 2 | Comparative Example 2 | Untreated White Cloth |
|---|---|---|---|
| Meter (L value) | | | |
| Water Fastness | 5 | 4 | — |
| Aging Fastness | 5 | 4 | — |
| Bleeding Fastness | 4 | 3 | — |
| Light Fastness | 5 | 4 | — |

EXAMPLE 3

A vinylon (polyvinyl alcohol fiber) plain fabric was pre-treated and dyed in the same manner as described in Example 1, whereby a fabric dyed in a sharp red color having a medium density. The color fastness of the dyed fabric was good.

COMPARATIVE EXAMPLE 3

A vinylon plain fabric was dyed in the same manner as in Example 3 except that the preliminary treatment was not carried out. The fabric was dyed only in a very faint color and the color fastness was very low.

The results obtained in Example 3 and Comparative Example 3 are shown in Table 3.

TABLE 3

| Measurement Item | Example 3 | Comparative Example 3 | Untreated White Cloth |
|---|---|---|---|
| Color Difference Meter (L value) | 36.23 | 62.41 | 74.37 |
| Water Fastness | 5 | 4 | — |
| Aging Fastness | 5 | 3 | — |
| Bleeding Fastness | 5 | 2 | — |
| Light Fastness | 5 | 4 | — |

EXAMPLE 4

A diacetate plain fabric was pre-treated and dyed in the same manner as in Example 2, whereby a fabric dyed in a sharp red color having a medium density. The color fastness of the dyed fabric was good.

COMPARATIVE EXAMPLE 4

A diacetate plain fabric was dyed in the same manner as in Example 4 except that the preliminary treatment was not carried out. The fabric was dyed only in a very faint color and the color fastness was very low.

The results obtained in Example 4 and Comparative Example 4 are shown in Table 4.

TABLE 4

| Measurement Item | Example 4 | Comparative Example 4 | Untreated White Cloth |
|---|---|---|---|
| Color Difference Meter (L value) | 40.11 | 68.21 | 77.13 |
| Water Fastness | 5 | 4 | — |
| Aging Fastness | 5 | 4 | — |
| Bleeding Fastness | 5 | 3 | — |
| Light Fastness | 4 | 3 | — |

EXAMPLE 5

A scoured rayon white cloth was treated in the same manner as described in Example 1 by using trimethylene-bis(3-chloro-2-hydroxypropyldimethylammonium chloride) obtained in Synthesis Example 1 as the cationic compound.

The treated cloth was immersed in an aqueous solution of Lanyl Black BG (1:2 type metal complex dye supplied by Sumitomo Chem. Co.) having a concentration adjusted to 2% o.w.f (bath ratio=1:50) and heated at 95° C. for 60 minutes. The cloth was taken out from the dye solution, sufficiently washed with hot water maintained at 90° C. and then air-dried. The cloth dyed in a dense black color. The color fastness of the dyed cloth was excellent and the light fastness was high.

COMPARATIVE EXAMPLE 5-1

The same rayon cloth as used in Example 5 was dyed in the same manner as described in Example 5 except that the preliminary treatment was not carried out. The cloth was only stained in a very faint gray color and the color fastness was very low.

COMPARATIVE EXAMPLE 5-2

The same scoured rayon cloth as used in Example 5 was pre-treated and dyed in the same manner as described in Example 5 that 3-chloro-2-hydropropyltrimethylammonium chloride was used as the cationic compound. The cloth was dyed in a grayish black color but the density was lower than in the cloth dyed in Example 5.

The measurements results obtained in Example 5 and Comparative Examples 5-1 and 5-2 are shown in Table 5.

TABLE 5

| Measurement Item | Example 5 | Comparative Example 5-1 | Comparative Example 5-2 | Untreated White Cloth |
|---|---|---|---|---|
| Color Difference Meter (L value) | 15.69 | 49.38 | 19.11 | 74.24 |
| Water Fastness | 5 | 4 | 3 | — |
| Aging Fastness | 5 | 3 | 3 | — |
| Bleeding Fastness | 4 | 3 | 2 | — |
| Light Fastness | 5 | 4 | 4 | — |

EXAMPLE 6

The solution obtained in Synthesis Example 5 was diluted 10 times with water, and 2.5% of sodium hydroxide and 0.1% of Despol 300 (polyoxyethylene nonylphenol ether type penetrant supplied by Ipposha Oil Industries Co.) were added to the dilution. An unscoured flax yarn wound in the form of a cheese was immersed in the resulting aqueous solution. The yarn/aqueous solution weight ratio was 1/20. The temperature was elevated by heating and the yarn was treated at 95° C. or 60 minutes. The yarn was taken out from the solution and sufficiently washed with water until the washing liquid became neutral.

The pre-treated yarn was immersed in an aqueous solution of Kayaku Acid Rhodamine Red FB (acid dye supplied by Nippon Kayaku Co.) having a concentration adjusted to 2% o.w.f. and a bath ratio adjusted to 1:20. The yarn was heated at 60° C. for 60 minutes, taken out from the solution, sufficiently washed with water and then air-dried. The thus obtained yarn was dyed in a dense red color, and the wet fastness was good and the light fastness was excellent.

COMPARATIVE EXAMPLE 6-1

The same unscoured flax yarn as used in Example 6 was dyed in the same manner as described in Example 6 except that the preliminary treatment was not carried out. The yarn was only stained in a very faint color, and the fastness was very low.

COMPARATIVE EXAMPLE 6-2

The same yarn as used in Example 6 was preliminarily treated and dyed in the same manner as described in Example 6 except that 3-chloro-2-hydroxypropyltrimethylammonium chloride was used as the cationic compound. A yarn dyed in a light color was obtained.

Each of the dyed yarns obtained in Example 6 and Comparative Examples 6-1 and 6-2 and the untreated flax yarn was uniformly wound on hard paper and the color was measured by the color difference meter. The obtained results are shown in Table 6. Furthermore, the fastness measurement results are shown in Table 6.

TABLE 6

| Measurement Item | Example 6 | Comparative Example 6-1 | Comparative Example 6-2 | Untreated White Cloth |
|---|---|---|---|---|
| Color Difference Meter (L value) | 33.61 | 62.97 | 40.55 | 79.31 |
| Water Fastness | 5 | 4 | 4 | — |
| Aging Fastness | 5 | 3 | 3 | — |
| Bleeding Fastness | 4 | 3 | 2 | — |
| Light Fastness | 5 | 4 | 4 | — |

EXAMPLE 7

The aqueous solution obtained in Synthesis Example 5 was diluted 10 times with water, and when sodium hydroxide was added little by little to the dilution to adjust the pH value to 7, a cationic compound represented by the following formula was formed:

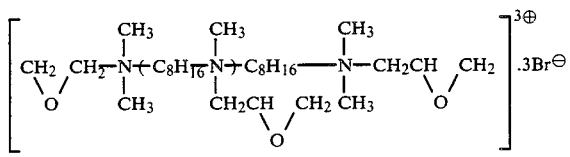

Then, 0.5% of potassium bicarbonate and 0.3% of Despol 300 were added to the above solution to form a treating solution. A scoured wool muslin white cloth was immersed in the treating solution at room temperature and squeezed at a pickup of 90% by means of rolls. Then, the cloth was wound in the form of a roll and packed in a polyethylene bag. The polyethylene bag was sealed and the cloth was allowed to stand at room temperature (about 25° C.) for 16 hours. Then, the cloth was taken out from the bag, washed sufficiently with water and then ari-dried.

The treated cloth was immersed in an aqueous solution of Kayarus Supra Blue BWL (direct dye supplied by Nippon Kayaku Co.) having a concentration adjusted to 3% o.w.f. and a bath ratio adjusted to 1:50, and the temperature was elevated and the cloth was heated at 80° C. for 50 minutes. Then, the cloth was washed sufficiently with water and then air-dried. A cloth dyed in a dense blue color.

COMPARATIVE EXAMPLE 7-1

The same wool muslin white cloth as used in Example 7 was dyed in the same manner as in Example 7 without the preliminary treatment. The cloth was dyed in a very faint blue color but the color fastness was very low.

COMPARATIVE EXAMPLE 7-2

The same wool muslin white cloth as used in Example 7 was pre-treated and dyed in the same manner as described in Example 7 except that 2,3-epoxypropyltrimethylammonium chloride was used as the cationic compound. The obtained dyed cloth had a blue color, the density of which was lower than the density of the color of the dyed cloth obtained in Example 7.

The measurement results obtained in Example 7 and Comparative Examples 7-1 and 7-2 are shown in Table 7.

TABLE 7

| Measurement Item | Example 7 | Comparative Example 7-1 | Comparative Example 7-2 | Untreated White Cloth |
|---|---|---|---|---|
| Color Difference Meter (L value) | 17.48 | 59.76 | 25.37 | 70.14 |
| Water Fastness | 5 | 4 | 3 | — |
| Aging Fastness | 5 | 4 | 2 | — |
| Bleeding Fastness | 4 | 3 | 2 | — |
| Light Fastness | 5 | 4 | 4 | — |

EXAMPLE 8

A bleached cotton gabardine woven fabric was immersed in an aqueous solution containing 3% o.w.f. of Procion Blue H-ERD (reactive dye supplied by ICI), 50 g/l of Glauber salt and 20 g/l of soda ash at a bath ratio of 1:20, and the temperature was elevated and the fabric was heated at 80° C. for 60 minutes to effect dyeing. The dyed cloth was washed with water, neutralized with acetic acid, washed with boiling water for 10 minutes, washed with water and then air-dried.

The dyed cloth was immersed in an aqueous solution containing 2% of hexamethylene-bis(3-bromo-2-hydroxypropyldiethylammonium bromide) and 1.2% of potassium hydroxide, and the cloth was squeezed at a pickup of 80% by means of rolls and then dried in a hot air drier maintained at 110° C. for 10 minutes.

The treated cloth was sufficiently washed with water and immersed in a 2% aqueous solution of FWA-105 (detergent supplied by Ipposha Oil), and washing was carried out at 95° C. for 10 minutes. Then, the cloth was washed with water and then dried. The color hue was not changed by this post treatment, and the wet fastness was highly improved by the post treatment over the wet fastness of the as-dyed cloth (not subjected to the post treatment). The measurement results are shown in Table 8.

TABLE 8

| Measurement Item | Example 8 | Example 8 (as-dyed cloth) |
|---|---|---|
| Water Fastness | 5 | 3 |
| Aging Fastness | 5 | 3 |
| Bleeding Fastness | 5 | 2 |
| Light Fastness | 5 | 4 |

EXAMPLE 9

A scoured bleached cotton knitted fabric was immersed in an aqueous solution containing 10% o.w.f. of Remazol Black B (reactive dye supplied by Hoechst AG), 80 g/l of Glauber salt and 20 g/l of soda ash at a bath ratio of 1:20, and the temperature was elevated and the cloth was heated at 60° C. for 60 minutes. The cloth was washed with water, neutralized with acetic acid, washed with water and then dired to obtain a black dyed cloth. The color fastness was very low.

The aqueous solution obtained in Synthesis Example 6 was diluted 10 times with water and 2% of sodium hydroxide was added to the dilution. The black dyed cloth was immersed in the obtained aqueous solution, squeezed at a pickup of 100%, dried at 110° C. for 10 minutes and then heat-treated at 150° C. for 3 minutes. Then, the treated dyed cloth was sufficiently washed with water, washed at 90° C. for 15 minutes with an aqueous solution containing 1 g/l of soap and then dried. The fastness was highly improved by the post treatment. The measurement results are shown in Table 9.

TABLE 9

| Measurement Item | Example 9 | Example 9 (as-dyed cloth) |
|---|---|---|
| Water Fastness | 5 | 3 |
| Aging Fastness | 5 | 2 |
| Bleeding Fastness | 5 | 1 |
| Light Fastness | 5 | 4 |

I claim:

1. A method for improving the dyeing properties of a textile material, which comprises treating a textile material composed of a natural fiber, a regenerated fiber, a semisynthetic fiber, a polyvinyl alcohol fiber or a mixture thereof with a cationic compound represented by the following general formula before or after dyeing of the textile material with an anionic dye, an indigo dye or a vat dye:

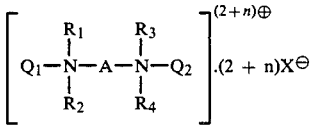

[I]

wherein A is a group represented by the following general formula: [II]:

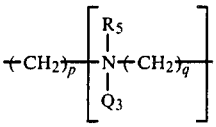

[II]

in which each of p and q is an integer of 1 to 8, n is an integer of 0 to 2, X is a halogen atom, each of $R_1$, $R_2$, $R_3$, $R_4$ and $R_3$ is independently an alkyl having 1 to 4 carbon atoms, an alkyl having 1 to 4 carbon atoms which has at least one substituent selected from the group consisting of hydroxyl and cyano, or an alkenyl having 2 to 4 carbon atoms, and each of $Q_1$, $Q_2$ and $Q_3$ is independently a group of the following formula:

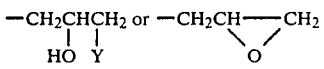

in which Y is a halogen atom and X and Y may be the same or different.

2. A method according to claim 1, wherein a solution containing 1 to 200 g/l of the compound [I] is applied to the textile material before or after dyeing.

3. A method according to claim 1, wherein an alkali is used in combination with the compound [I] in an amount of 1 to 100% by weight based on the compound [I].

4. A method according to claim 1, wherein the natural fiber is a cellulosic fiber, a wool fiber or a silk fiber.

5. A method for improving the dyeability of a textile material according to claim 1, wherein the regenerated fiber is a viscose man-made fiber, a cuprammonium man-made fiber ot a soybean protein man-made fiber.

6. A method for improving the dyeability of a textile material according to claim 1, wherein the semisynthetic fiber is an acetate fiber.

7. A method for improving the dyeability of a textile material according to claim 1, wherein the anionic dye is a direct dye, a reactive dye, or an acid dye.

* * * * *